United States Patent [19]

Planchon

[11] Patent Number: 4,821,843

[45] Date of Patent: Apr. 18, 1989

[54] FOLDING LADDER

[76] Inventor: Paul O. Planchon, 2580 Melody Lane, Reno, Nev. 89512

[21] Appl. No.: 169,579

[22] Filed: Mar. 17, 1988

[51] Int. Cl.[4] ..... E06C 1/10; E06C 1/383

[52] U.S. Cl. ..... 182/178; 182/163

[58] Field of Search ..... 182/163, 164, 178, 156

[56] References Cited

U.S. PATENT DOCUMENTS

| | | | |
|---|---|---|---|
| 2,183,251 | 12/1939 | Beggs | 182/163 |
| 3,078,953 | 2/1963 | Silen | 182/163 |
| 3,286,789 | 11/1966 | Planchon | 182/163 |
| 4,718,518 | 1/1988 | Brown | 182/178 |

FOREIGN PATENT DOCUMENTS

| | | | |
|---|---|---|---|
| 2137681 | 10/1984 | United Kingdom | 182/156 |

*Primary Examiner*—Reinaldo P. Machado

*Attorney, Agent, or Firm*—Herbert C. Schulze

[57] ABSTRACT

A folding ladder primarily designed for use of roof estimators wherein said folding ladder is long enough to get to the average roof, but is yet not cumbersome to handle as are most extension ladders, and wherein the ladder hinges and folds into a flat package when not in use, with sliding side rail locking devices which also fold and hinge when not in use, but when extended which slide over the hinge positions of the ladder, and hold it in full length for use, additionally provision is made for a separate and distinct extension element having sliding side locking rail devices.

3 Claims, 4 Drawing Sheets

FIG. 1.
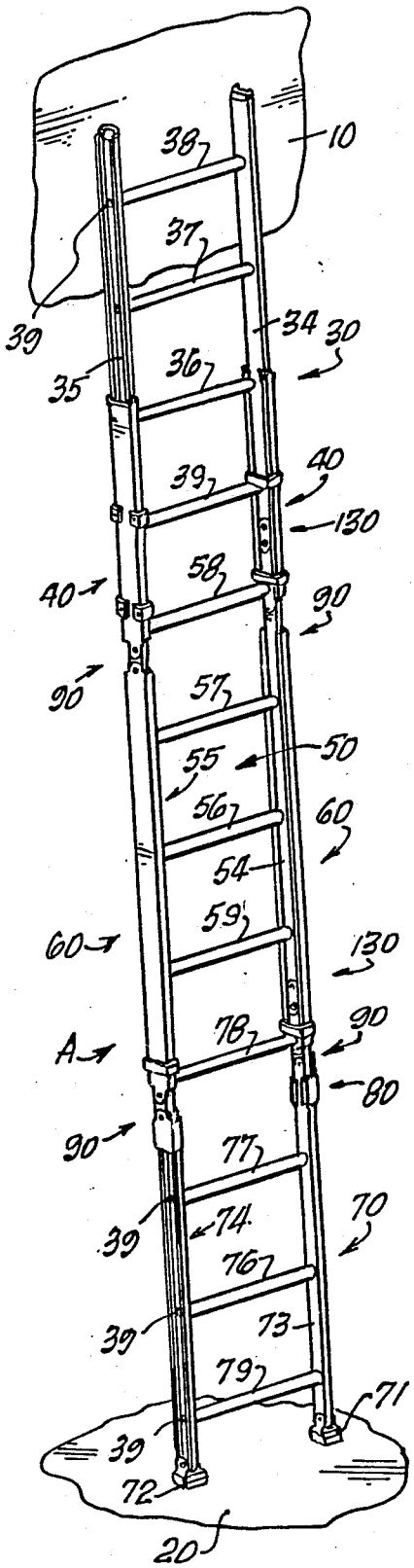
FIG. 2.
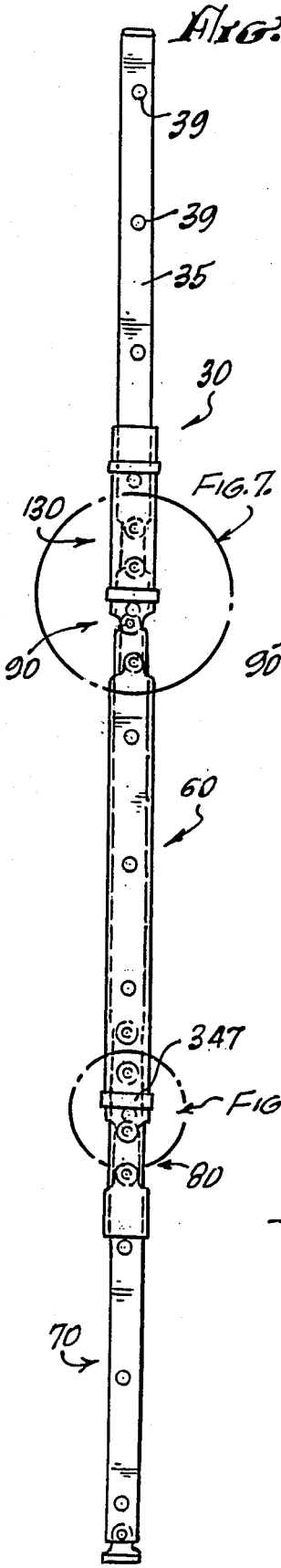
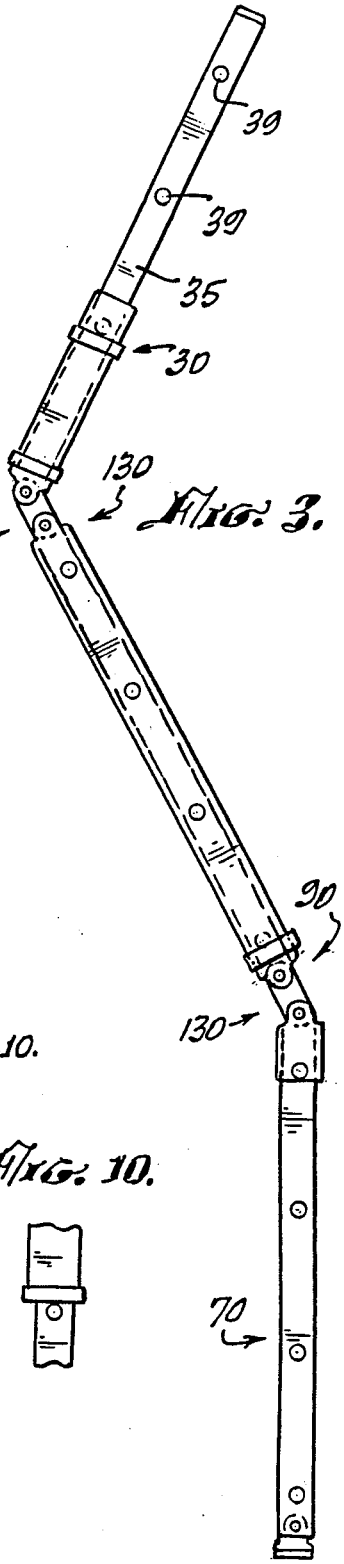
FIG. 3.
FIG. 10.

FIG. 12.
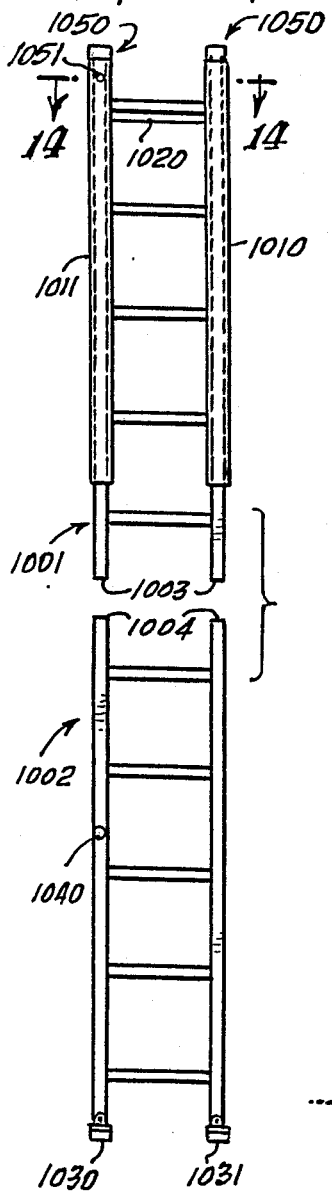
FIG. 13.
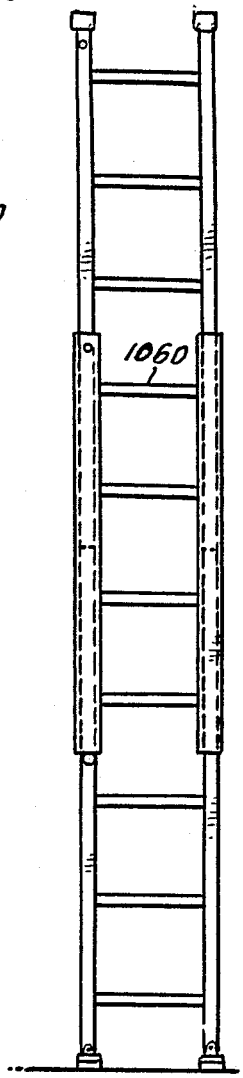
FIG. 14.
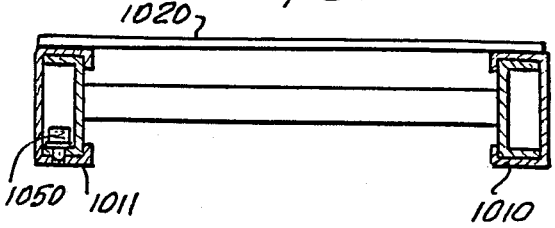
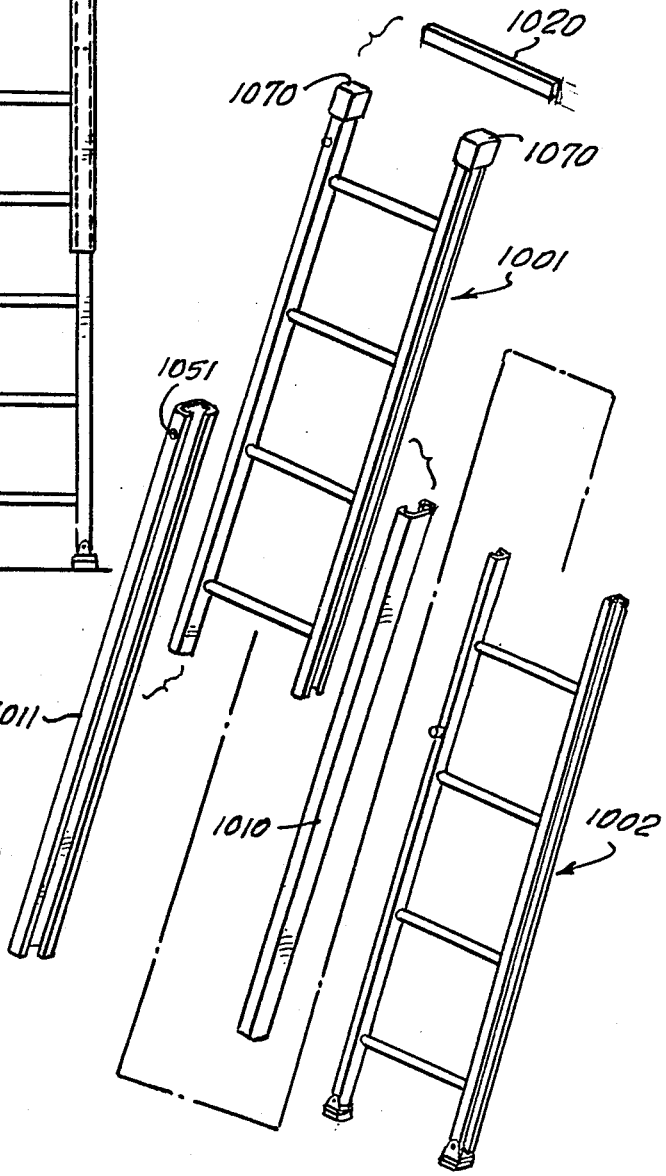
FIG. 15.

FOLDING LADDER

CROSS REFERENCE TO RELATED PATENT APPLICATIONS

There are no applications for patent applied for by me related to this application. However, I was previously issued U.S. Pat. No. 3,286,789 on a somewhat similar device but over which I have made unique and useful inventions as described in this application.

BACKGROUND OF THE INVENTION

I. Field of the Invention

This invention is in the field of ladders for persons to use in climbing on a building or the like. The invention is even more particularly directed to a ladder which is short in length, when not in use, particularly short enough to be stored in the trunk of an automobile. The invention is even more particularly directed in the field of a ladder consisting of a multiplicity of hinged sections with a hinged locking device which holds the hinged ladder sections rigid, constituting one elongated ladder when in use, additionally a separate connectable section may be provided.

II. Description of the Prior Art

There are many elongated and extension ladders available which are known to those skilled in the art. In general these consist of ladder sections which slide alongside each other to locking positions at appropriate desired lengths, or just single elongated long ladders.

Heretofore, I invented, and received U.S. Pat. No. 3,286,789 on a hinged ladder, which, at a glance, would appear to have characteristics similar to the present invention. This however is not true, since the present invention incorporates unique new hinging and stop devices and the like for safety, added convenience, and economy in such manner that an entire new invention has developed as to which I consider there is not prior art, particularly in the unique hinging feature of slides which maintain the ladder in a rigid condition when in use, yet easily allow for folding into a small package when not in use, together with additional sections which may be connected for further elongation if desired.

SUMMARY OF THE INVENTION

The use of long ladders is wide spread in the construction and other related industries to enable persons to climb to relatively high positions, including the roofs, of buildings. In particular, one rather large use for such ladders is for roofing estimators. This frequently presents an unusual problem in that roofing estimators customarily will travel in an ordinary automotive vehicle as opposed to a truck or the like, and are not able to carry long ladders. Therefore, when they reach their jobs they must rely upon a long ladder being available, which frequently is found to be not available.

I have studied the problem of extension ladders and the like for many years, and previously have invented, and obtained U.S. Pat. No. 3,286,789 on one such device which consists of a multiplicity of hinged units with a sliding, and, also, hinged apparatus which, when in use, will lock the hinged sections into one elongated ladder. Although this invention was a considerable advance in the art, I continued to work on other problems and ultimately conceived and developed the unique combination presented in this patent application having features which are unique and useful and have not heretofore been known, for accomplishing the desired end result.

The manner in which I accomplish this is to take three more or less normal ladder sections, particularly those made of aluminum or other metallic side rails, each section having four rungs, and the sections being hinged so that the distance between the rungs on two adjoining hinged portions is the same as the distance between rungs on any individual section of the ladder.

I then cut out a sufficient portion of the edge of the rail of the ladder so as to allow an interior hinging device to slide therein. I then hinge the two side walls of adjoining ladder sections with a hinging device which will be described in detail below.

I then equip each side of the ladder with a channel shaped device having flanges which properly slide over the outer rails of the ladder sections. I make these portions in sections one of which on each side is the full length of one section and each of the others is a partial length of the ladder section. These different units are hinged together on each side so that when the one piece which is the full length of one section is in place on the middle section with the hinges all adjoining each other, the entire unit folds into a three section package.

When it is desired to use the item, the hinged areas are straightened out and the ladder feet are placed down on the surface upon which they will rest, and the channel members which encompass the side rails move to a position where the rigid channel members cover the hinged areas of the ladder sections and thus hold them rigid at their hinged positions. I provide strengthening strap stop arrangements which allow the exterior hinged channels to move to a position where they are held in place so that the ladder remains rigid while in use.

When work is completed with the ladder the hinged side members are easily moved to the position where their hinges align with the hinges of the ladder section and the entire unit is once again folded into an easily transported package.

Additionally, I have provided a separate sliding and locking arrangement of a further extension if desired or as a separate extendable ladder in itself.

It is an object of this invention to provide a collapsible ladder which may be extended into a long ladder;

It is a further object of this invention to provide such a ladder that it may be carried in the trunk of an ordinary automobile in its collapsed form;

It is a further object of this invention to provide such a ladder as described with improved safety and convenience features.

The foregoing and other objects and advantages of this invention will become apparent to those skilled in the art upon reading the description of a preferred embodiment which follows, in conjunction with a review of the appended drawings.

BRIEF DESCRIPTION OF THE DRAWINGS

FIG. 1 is a schematic perspective view from the left front of the ladder of this invention when in position for use as a ladder;

FIG. 2 is an enlarged side elevation from the left of FIG. 1 it being understood that the exact same side elevation would apply from the right as a mirror image;

FIG. 3 is a side elevation from the left (the right side being identical except that when being folded as is shown it would be a mirror image), of FIG. 2 when being folded;

FIG. 10 is a partially broken away schematic view illustrating the manner in which the hinged area of the ladder leg is locked in position by the outer sleeve;

FIG. 12 is a front elevation of another alternative embodiment utilizing an extension element not involving a hinge;

FIG. 13 is a front elevation of the embodiment of FIG. 12 with locking sleeve in position;

FIG. 14 is a section 14—14 of FIG. 13; and

FIG. 15 is an exploded perspective of the elements of the embodiment of FIGS. 12, 13 and 14.

DESCRIPTION OF A PREFERRED EMBODIMENT

Figures 4, 11:
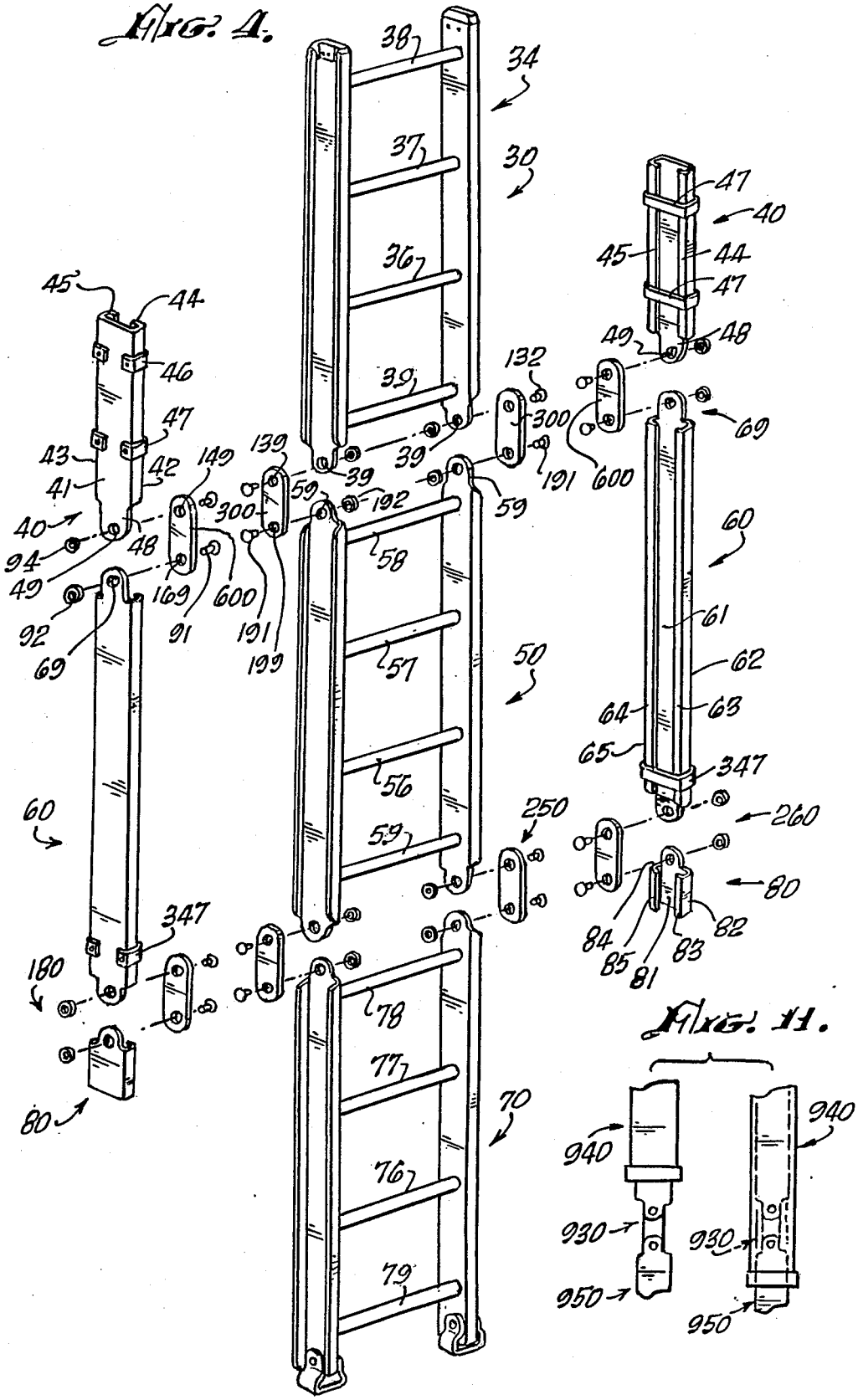
FIG. 4 is an exploded view of the elements of this invention.
FIG. 11 is a schematic, partially broken away alternate embodiment of the locking sleeve in two positions.

FIG. 1 illustrates a ladder of this invention in place and ready to be used. The ladder is seen to consist of three segments 30, 50, and 70. Each ladder segment will have two channel like side members 34, 35, 54 and 55, and 74 and 75 respectively and four rungs 39, 36, 37, 38, 59, 56, 57, 58 and 79, 76, 77 and 78 of customary construction as is commonly used and well known in the trade in ordinary aluminum ladders or aluminum extension ladders. In this case, the ladder is resting upon the ground or other base 20 by customary ladder feet 71 and 72 and is resting at its upper end against the wall or the edge of a roof 10.

The sliding outer rails which will hold the three segments in a rigid position, or allow it to be folded, are generally respectively 40, 60, and 80, it being noted that these are channel shaped items, one on each side rail of the ladder portions. Each of the rungs of the ladder is attached to each of the side rails in normal fashion as indicated at 39. Each of the ladder segments will be attached to its adjoining ladder segment by a hinge arrangement generally 130 and each of the outer rails 40, 60, and 80 will be connected to one another by a hinge arrangement generally 130. The action of the hinges and their components will be understood by specific attention to FIG. 7 which will be described later.

The components, however, are shown in exploded view form in FIG. 4. FIGS. 2 and 3 merely show the ladder in its extended position and when it is in position to be folded and is partially folded.

In FIG. 4 the elements of the three segments 30, 50 and 70 are shown and it is particularly important to take note of the manner in which the side rails have been cut down immediately below rung 35, immediately above rung 58, immediately below rung 55, and immediately above rung 78 so as to provide a tab like projection at 39 with a hole, on each side rail of ladder segment 30 as indicated. Likewise, at 59 the side rail has been cut out as indicated to provide a tab at 59 on segment 50 adjacent rung 58. By use of bolts 191 through holes 199 and bolts 132 through holes 139 in conjunction with said tabs it is seen how a hinge is formed utilizing the hinge plate elements 300. The same structure will apply to the hinge elements (indicated at 250) between segments 50 and 70 of the ladder. For clarity numerals have not been completely assigned to these units but they are the same as the ones illustrated between ladder segments 30 and 50.

The side rail elements 40, 60, and 80 are illustrated and it is seen how side rail element 40 has a generally channel shaped configuration which will slip over the outside of one of the slide side rails of the ladder segments. There is an overhanging lip 45 which holds this side element in position as is more clearly shown in FIG. 9, in which the lips are actually numbered 83 and 85 since this is a sectional view of an alternate embodiment but wherein the lips 83 and 85 are the same as lips 44 and 45 in FIG. 4. Side rail element 40 has two straps at 46 and 47 which act as stops between rungs 35 and 36. These straps obviously are applied by rivets or the like or may be welded as is known to those skilled in the art after the side rail 40 has been placed over the side rail of ladder element 30. The end of that rail has been cut out to provide tab 48 with hole 49 to accommodate the hinging element 600 which is similar to hinging element 300. It will be seen how this, in conjunction with the tab and hole at 69 will provide hinging for the side rail elements. A similar structure exists at 260 between elements 60 and 80.

In FIG. 4 there is also shown the element 600, on its left side with holes 149 and 169 fastened with bolts 93 and 94 and 91 and 92 through holes 49 and 69 in adjacent side pieces 60 and 40.

A similar structure exists at the lower end of element 60 and the short element 80 and their associated connectors shown only generally at 260.

The elements of the lower side portion 80 are shown, and they include the tab (unnumbered) and the back channel member 81, two side channel members 82 and 84 and the two flange members 85 and 83 which hold the unit upon the side rail of the ladder.

The strap 347 shown at the bottom of each of the side sections 60 is applied after the unit is in place and acts as a stop against rungs 78 thus providing the rigidity when these items are completely in place for use. When not being used they are bent as shown in FIG. 2 and ultimately into a final package at FIG. 5 and held together with a strap or the like 357 so they may be stored n the trunk 510 of an automobile as shown at FIG. 6.

Figure 7:
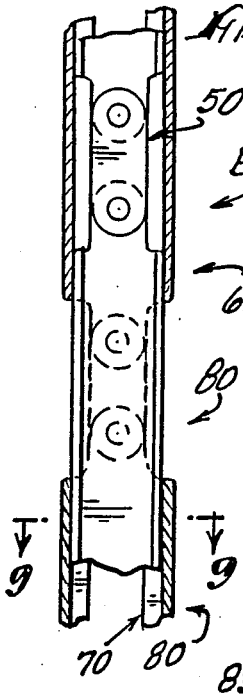
FIG. 7 is a partially sectioned, partially schematic view of the hinge area of the ladder and its side slides.

FIG. 7 illustrates partially in section and schematically the hinged portion of the ladder at B and the hinged portion of the side sliding rails at C.

Figure 8:
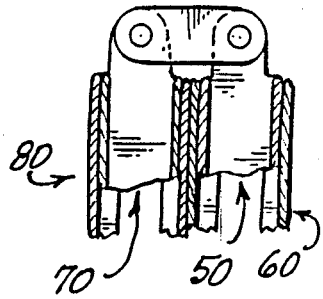
FIG. 8 is a partially schematic partially sectioned view of one hinge area.

At FIG. 8 the condition of the entire element is indicated partially showing the hinged connection between the elements shown in FIG. 7.

Figure 9:
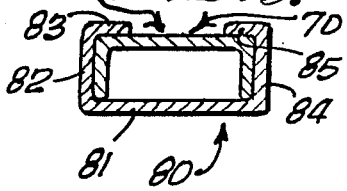
FIG. 9 is a section through 9—9 of FIG. 7.

FIG. 9 being a cross section, shows the construction of the outer member which slides over the ladder rails having a plate 81, sides 82 and 84, and lips 83 and 85, which confine the ladder side member 70.

Figure 5:
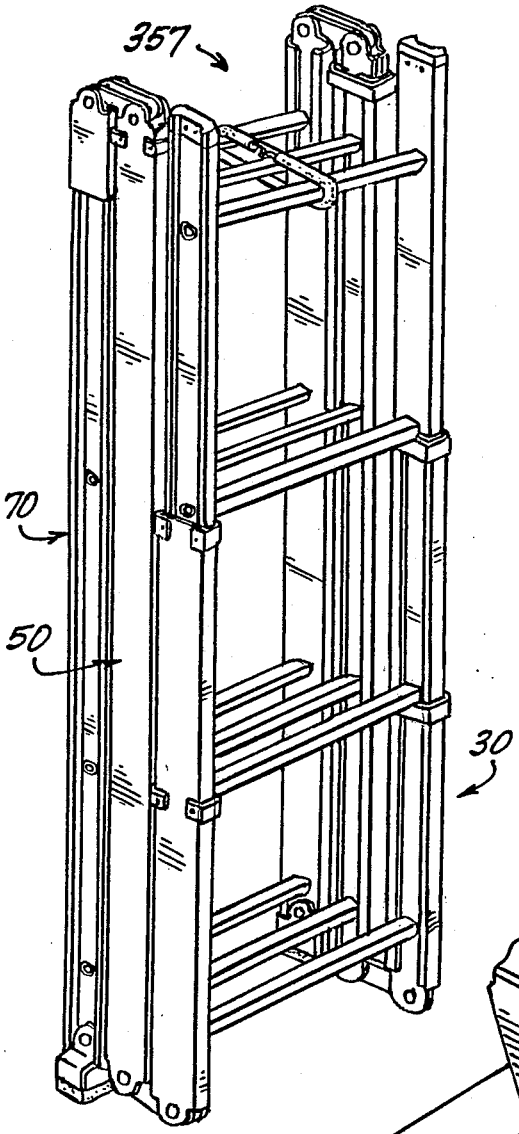
FIG. 5 is a perspective of the ladder of this invention when folded for carrying within the trunk of a vehicle.
Figure 6:
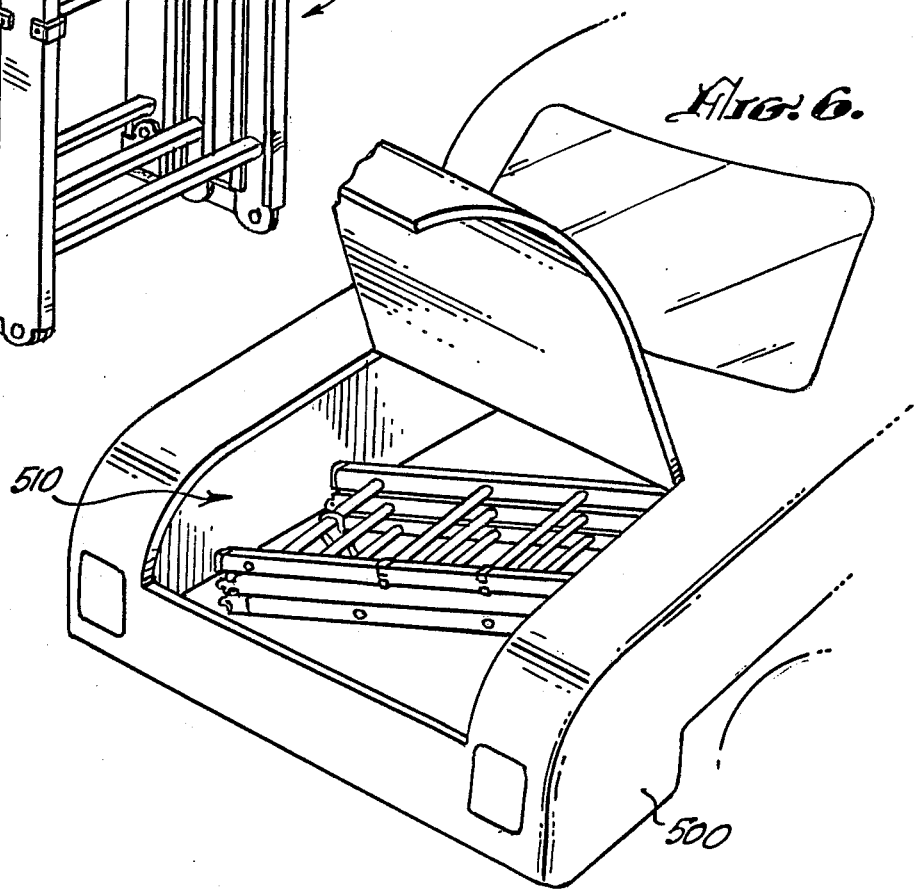
FIG. 6 is a partially broken away, schematic perspective of the trunk of an automobile with the folded ladder in place therein.

In use, the ladder will be operated as indicated in FIGS. 1, 2, 3 and 5. In FIG. 5 it will be noticed that the outer hinging slides are now in such a configuration that they align perfectly with the actual ladder section hinges thus providing the completely folded compact package.

In FIG. 3 it is seen that the condition of the hinging elements as indicated in FIG. 5 also, is such that the entire unit can now be folded flat with the three elements of the ladder against each other. It will be noted that the hinge 130 and the hinge 90 in each case are now in alignment so as to allow full folding. On the other hand, in FIG. 2 it is noted how the hinge elements and the sliding side rail elements are so aligned that ladder rails 30 and 50 are locked together over their hinged connection and likewise ladder rails 50 and 70 are locked together over their elements by means of the outer rails 40, 60 and 80. Thus the hinges cannot move and the unit stays in one piece.

The straps 46, 47 and 347 which are best seen in the exploded view of FIG. 4 are shown to be resting on rungs 39 and 58 in FIGS. 1 and 2 when the ladder is in its extended and locked position. Likewise, the strap 347 is resting against rung 78 when that particular configuration is utilized.

The small guide element 80 and its hinge arrangement may, however, be completely eliminated without changing the operation of this apparatus. When the side rail element 80 is eliminated on each side, likewise the tab at the bottom of the outer slide 60 will be eliminated and the strap 347 will still rest upon rung 78, with the extension below that to where the tab would otherwise have occurred will hold those two sections in locked condition when the strap 347 is against the rung 78.

It will thus be seen that only two side rail elements are actually necessary to accomplish the entire purpose of this invention is desired, and this will eliminate the necessity of the guide portion 80 on each side and make for some economy, although the guide portion 80 on each side aids in aligning when the segments are folded are are being unfolded to lock together.

It is to be recognized that the hinged ladder device of this invention could in fact be made using only two hinge elements, for example the section 70 and the section 30 could be a complete ladder with the one hinging element and the sliding locking device over the one hinged element. In this manner, for example, a ladder might be constructed with more or less than four rungs in each section and only two sections utilized. Likewise a fourth section could be added as will be clear to those skilled in the art so the number of sections is not governing as to this invention.

FIG. 11 shows an alternate embodiment which would be the embodiment suggested wherein the locking device only is illustrated to consist of a sliding channel member 940 with the hinge 930 wherein the sliding member 940 slides down over the lower side rail of adjoining rails and covers the hinge thus locking it in position.

FIGS. 12, 13, 14 and 15 should be viewed together, and they illustrate the possibility of a separate type extension arrangement wherein the ladder segments are not hinged together, but are held together merely by gravity of two sections adjacent to one another and having side rail elements similar to what has previously been described so that either a hinged ladder element or two or more separate ladder elements may be extended utilizing the side rail hinge arrangement but without utilizing hinges. In this case two ladder elements of customary construction but having a plain end on the top of one, and on the bottom of the other or having an end which will cooperate in each case are illustrated. The sections of ladder are 1001 and 1002, with the plain ends being 1003 and 1004 respectively. The locking side rails 1010 and 1011 slide upon the ladder section 1001 as indicated. These two sliding rails are locked together by one or more straps 1020 which are welded or otherwise fastened to the two side rails. Preferably the lower section will have suitable feet 1030 and 1031 and the lower section will have a projection such as a bolt or the like at 1040 which will act as a stop for the side rails when they are slid down into position. This type stop, incidentally, may be also used in lieu of the straps which are used for stops in the embodiments shown in FIGS. 1, 2, etc. Likewise the pairs of rails may be held together in the embodiment shown in FIGS. 1, 2, etc. by the use of straps such as 1020 illustrated in FIG. 4. Also, in this embodiment there is illustrated a spring loaded ball and detent arrangement 1050, 1051 which will be known to those skilled in the art and by such arrangement slides will be held in position by the spring loaded ball or similar item at 1050 in the hole or detent 1051 of the side rail 1011. The strap 1020 or straps if more than one are used will be so positioned with relation to the ladder rungs that each strap will be directly behind a rung when the ladder is in its extended position for use. This will enable the user of the ladder to step upon the rung in normal fashion and not be bothered by the strap behind which will only become in effect a further portion of the rung. For example strap 1020 could be positioned on the side elements 1010 and 1011 immediately behind rung 1060 and thus it does not show in the illustration FIG. 13. It does not show in the sectional view FIG. 14 in section but is shown not in section because it is directly behind the rung 1060, when in use. When not in use it will be a little off of alignment with a rung but this will make no difference when the device is not being used.

Normally a plastic, rubber, or other end arrangement will be provided as at 1070 for the top portion to reset against a building or the like.

While the embodiments of this invention shown and described is fully capable of achieving the objects and advantages desired, it is to be understood that such embodiments have been shown and described for purposes of illustration only and not for purposes of limitation.

I claim:

1. An extension provision for a ladder comprising in cooperative combination a first ladder segment having feet, two side rails, and a multiplicity of rungs; a second ladder section so designed as to rest upon the top of the first ladder segment on its side rails and a sliding locking device suitable to slide over the side rails of both ladder sections to hold them in position together as a unit and wherein a stop device has been provided upon the first ladder section to stop the sliding side rails when they come into contact with such stop device.

2. The apparatus of claim 1 wherein the two sliding side rails are held together as a unitary piece by one or more straps so located as to be directly behind a rung of the ladder as assembled for use.

3. The apparatus of claim 2 wherein there is a spring loaded holding means associated with one of the side rails of the first ladder section and one of the side rails of second ladder section so that it is in a position where the two ladder sections are independent from one another when desired.

* * * * *